US011686116B2

(12) United States Patent
Bennett

(10) Patent No.: US 11,686,116 B2
(45) Date of Patent: Jun. 27, 2023

(54) PLUNGER WAVE MAKING GENERATOR SYSTEM

(71) Applicant: Walter Judson Bennett, Mechanicsville, VA (US)

(72) Inventor: Walter Judson Bennett, Mechanicsville, VA (US)

( * ) Notice: Subject to any disclaimer, the term of this patent is extended or adjusted under 35 U.S.C. 154(b) by 26 days.

(21) Appl. No.: 17/300,342

(22) Filed: May 18, 2021

(65) Prior Publication Data

US 2022/0372780 A1 Nov. 24, 2022

(51) Int. Cl.

| | |
|---|---|
| ***E02B 9/00*** | (2006.01) |
| ***E02B 9/08*** | (2006.01) |
| ***E04H 4/00*** | (2006.01) |
| ***F04D 35/00*** | (2006.01) |
| ***A63B 69/00*** | (2006.01) |

(52) U.S. Cl.
CPC ..... *E04H 4/0006* (2013.01); *A63B 69/0093* (2013.01); *F04D 35/00* (2013.01)

(58) Field of Classification Search
CPC ..... E04H 4/0006; Y02E 10/20; Y02E 10/30; A63B 69/0093; A63B 69/125; F04D 35/00; E02B 9/00; E02B 9/08; E02B 3/00; E02B 5/08; E02B 7/00; F03B 13/14; F03B 13/26
USPC ..... 405/79, 75, 76, 80
See application file for complete search history.

(56) References Cited

U.S. PATENT DOCUMENTS 2,908,141 A * 10/1959 Marsh, Jr. ..... B63B 21/502 114/294
3,191,386 A * 6/1965 Wiegel ..... E02B 3/062 405/91
3,299,846 A * 1/1967 Jarlan ..... B63B 39/005 405/195.1
3,350,724 A * 11/1967 Leigh ..... E04H 4/0006 4/491
3,373,568 A * 3/1968 Hornbostel, Jr. ..... E02B 3/04 405/91
3,431,879 A * 3/1969 Westling ..... E02D 5/74 114/294
3,472,032 A * 10/1969 Howard ..... E21B 43/01 166/359
3,487,228 A * 12/1969 Kriegel ..... F03B 13/187 60/497
3,487,645 A * 1/1970 Frankel ..... E02B 3/062 405/26
3,557,559 A * 1/1971 Barr ..... E04H 4/0006 4/491

(Continued)

FOREIGN PATENT DOCUMENTS

WO WO 2009058031 A1 5/2009

OTHER PUBLICATIONS

U.S. Appl. No. 10/501,957, filed Dec. 10, 2019, Aaron Trevis.

*Primary Examiner* — Edwin J Toledo-Duran

(57) ABSTRACT

A wave making apparatus for creating a surfing wave in a body of water. The waves are generated using a round bottom and front mechanical plunger. The plurality of round front plungers are assembled side by side in a vertical manner on a 90 degree back wall. The individual round front plungers actuate up and down, all at the same time, at different times, in sequence and can be placed in different shaped configurations to produce a swell into a body of water which then break of artificial surfing reefs to create a wave for surfing.

5 Claims, 6 Drawing Sheets

(56) References Cited

Figure 1:
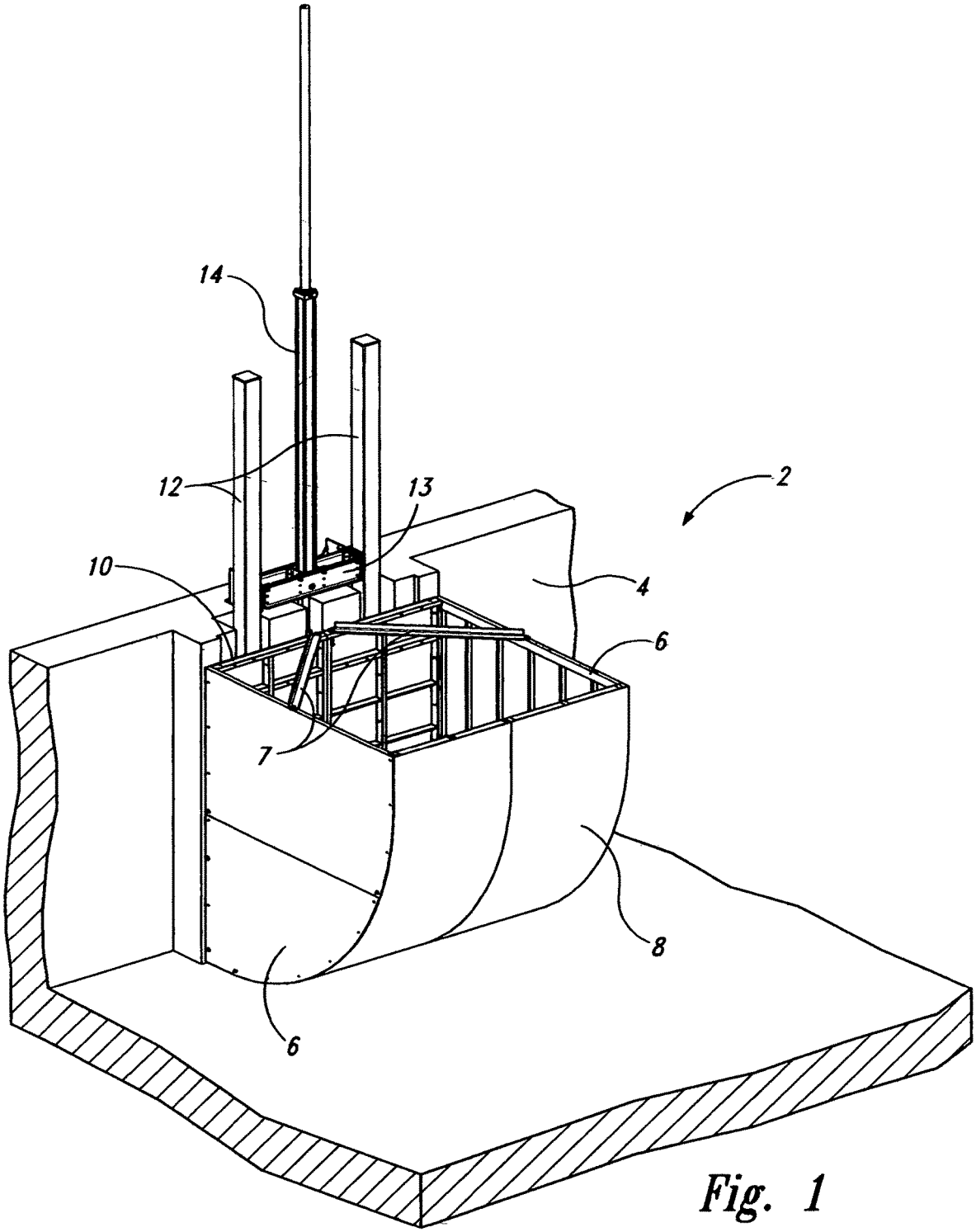

U.S. PATENT DOCUMENTS 3,789,612 A * 2/1974 Richard ..... E04H 4/0006 4/491
3,817,040 A * 6/1974 Stevens ..... E02D 7/24 114/295
3,927,330 A * 12/1975 Skorupinski ..... F03B 17/066 415/5
3,973,405 A * 8/1976 Duport ..... E04H 4/0006 4/491
3,981,612 A 9/1976 Bunger
3,986,471 A * 10/1976 Haselton ..... B63B 39/06 405/223.1
4,062,192 A * 12/1977 Biewer ..... E04H 4/0006 4/491
4,078,871 A * 3/1978 Perkins, Jr. ..... F03B 13/147 417/100
4,098,084 A * 7/1978 Cockerell ..... F03B 13/20 60/501
4,210,821 A * 7/1980 Cockerell ..... F03B 13/20 290/54
4,276,664 A * 7/1981 Baker ..... E04H 4/0006 4/491
4,434,375 A * 2/1984 Taylor ..... F03B 13/1885 60/504
4,507,018 A * 3/1985 Andersen ..... E02B 3/00 4/491
4,539,719 A * 9/1985 Schuster ..... E04H 4/0006 4/491
4,627,240 A * 12/1986 Holmes ..... F03B 13/1845 60/497
4,684,815 A * 8/1987 Gargos ..... F03B 13/20 60/501
4,686,377 A * 8/1987 Gargos ..... F03B 13/20 417/332
4,698,969 A * 10/1987 Raichlen ..... F03B 13/187 210/170.11
4,705,428 A * 11/1987 Andersen ..... E04H 4/0006 4/491
4,773,221 A * 9/1988 Noren ..... F03B 13/187 60/497
4,783,860 A * 11/1988 Funke ..... G01M 10/00 4/491
4,810,129 A * 3/1989 Guevel ..... E04H 4/0006 4/491
4,976,570 A * 12/1990 Davis ..... F04D 35/00 4/491
5,171,101 A * 12/1992 Sauerbier ..... E04H 4/0006 405/52
5,320,449 A * 6/1994 Demarteau ..... E04H 4/0006 4/491
5,342,145 A * 8/1994 Cohen ..... E04H 4/0006 4/491
5,347,145 A * 9/1994 Tanaka ..... G01R 31/2884 257/203
5,564,859 A * 10/1996 Lochtefeld ..... A63B 69/0093 405/52
5,621,925 A * 4/1997 Bastenhof ..... E04H 4/0006 4/491
6,164,870 A * 12/2000 Baruh ..... E02B 3/108 405/91
6,217,256 B1 * 4/2001 Inan ..... E04H 4/0006 4/491
6,716,107 B2 * 4/2004 Lochtefeld ..... A63G 3/02 472/117
9,534,408 B2 1/2017 Osterman
9,920,544 B1 3/2018 Bennett
10,519,679 B1 12/2019 Bennett
10,760,290 B1 9/2020 Bennett
2007/0081861 A1 * 4/2007 Goble ..... E02B 9/08 405/79
2008/0018114 A1 * 1/2008 Weldon ..... F03B 13/187 290/53
2011/0209280 A1 9/2011 Enjo
2017/0204627 A1 7/2017 Trevis

* cited by examiner

PLUNGER WAVE MAKING GENERATOR SYSTEM

BACK GROUND OF THE INVENTION

Plunger wave makers are very efficient ways to produce waves and swells in a body of water. They are comparable to modular piston wave makers in quality of waves produced. However, plunger wave makers are more energy efficient then piston wave makers. Plungers can be operated on different degree sloped back walls. They can be built on sloped walls from 30 degrees to 90 degrees. The optimal front face of the plungers to the still water line should optimally be between 0 and 40 degrees. The design of the plunger is very important in determining the efficiency and the height and quality of waves produced. For instance, a plunger design that has a flat bottom will cause vortices on the downward stroke. Collins English Dictionary defines a vortex, as a whirling mass or rotary motion in a liquid, gas, flame, such as the spiraling movement of water around a whirlpool. The vortices are pushed out in front of the plunger and distorts the size and quality of the solitary wave being pushed out. A plunger design that has an angled flat front, will cause the water particles interacting with the front of the plunger to slightly bow outward from the front of the plunger. Also, at the top of the flat front there will be a slight small pre break of the wave. Plungers that are square in shape and have a flat front with no curves or round edges will also create a vortex off the corners of the plunger. The only way to stop currents under the plungers or vortex in front of the plungers or small waves breaking at the top of the plungers, is to use a round bottom and round front shaped plunger design.

PRIOR ART

In U.S. Pat. No. 9,920,544 Walter Bennett, John Bushey and Mathew Gunn, is a plunger wave maker that is made out of steel panels, that uses a single hydraulic actuator connected to a belcrank and drive link mechanism, to push down and pull up the plungers. The plunger design has a flat bottom and flat angled flat front and is on a 45-degree back wall slope. This patent teaches away from the current invention, because the current invention is round on the bottom and is round in the front. In the current invention the round plunger design is actuated on a 90-degree back wall. The current invention also does not use a belcrank or drive link to assist in actuating the plungers up and down.

In U.S. Patents 20170204627A1 and WO2015188219A1, Aaron Trevis, the invention provides wave generation by means of a solid circular large plunger placed in the middle of a lake. Trevis patents teach away from the current invention, because the current invention is a plurality of individual rounded bottom and round front plungers.

In U.S. patent Ser. No. 10/501,951, Aaron Trevis, is a plunger wave generating system for use in a wave pool defining body of water having a water surface and a shoreline. The wave generating system comprises a solid circular shaped plunger having movable portions for adjusting a side cross section profile of the plunger.

In U.S. Pat. No. 10,519,679 B1 Walter Bennett, a wave making plunger constructed of solid geo foam and fiberglass.

In U.S. Pat. No. 3,973,405 A Dupont, improvements to surge generators of the plunger type for generating surge in a test tank.

In U.S. Pat. No. 3,789,612 Richard, the wave generator is a buoyant plunger mounted for a vertical reciprocation within a chamber having a shoreward facing opening.

In U.S. Pat. No. 4,276,664, Baker, an apparatus is provided for making waves in bodies of water used for swimming. Having a plurality of hollow open bottom piston plungers mounted for reciprocation.

In U.S. Pat. No. 10,760,290B1, Walter Bennett, a plunger wave making apparatus for creating a surface in a body of water. The waves are generated by a plurality of side-by-side individual plungers oscillating up and down. The plungers do not have a round front or a round bottom and are not positioned on a 90-degree back wall, but rather a 45-degree back wall.

In U.S. Pat. No. 3,981,612A, Charles Bunger, Wave producing apparatus, as for simulated surfing, skateboard riding, and the like, including a flexible elongate web and nether carriage means upwardly flexing the web and movable longitudinally thereof to produce a traveling wave.

In U.S. Pat. No. 3,350,724A, Walter Leigh, this invention relates generally to the art of generating artificial waves and breakers in lakes, swimming pools, and the like. The invention relates, more particularly, to improved wave-generating apparatus for this purpose.

It is known in the art to generate, for the amusement of bathers, artificial waves and breakers in small bodies of water, such as swimming pools and lakes, which are devoid of natural waves and breakers. Typical existing wave-generating apparatus for this purpose are equipped with reciprocating plungers which are driven up and down in the body of water at the proper frequency to create the desired wave motion in the water.

In U.S. Pat. No. 9,534,408B2, Ross Osterman, Present embodiments are directed to a system and method for generating waves in multiple directions. Present embodiments may include a wave generation mechanism configured to be positioned centrally within a container filled with water that is sufficiently sized to facilitate recreational activities for patrons within the container. The wave generation mechanism may include at least one actuator configured to activate at least one water-displacement medium to displace the water such that waves are propagated through the water, and a directional feature configured to direct the waves away from the wave generation mechanism after activation of the actuator such that the waves are propagated outward from the wave generation mechanism in multiple directions.

In WO2009058031A1, Kerry Black, this invention relates to improvements in and relating to wave generation. In particular, this invention is directed to a means of producing high quality surfing waves for a surfing pool. This is affected via an improved wave generating caisson where the pressure means adapted to periodically apply force against the surface of water contained in the caisson, to displace said water from the caisson chamber, is achieved via hydraulic mechanical plunger means. The invention is used in conjunction with computer technology and software to enable wave profiles to be precisely specified. Channeling means are adapted to redirect water from an end of the swimming pool back to the chamber(s) to reset the chamber(s) for further wave generation and at the same time facilitate preferred breaking pf generated waves travelling along the swimming pool.

In US20110209280A1, Justin Enjo, the present invention provides an apparatus and method for improving the creation of plunging and peeling waves in a pool or body of water. The improvement is accomplished by orientating one or more wave making devices at an acute angle to one another and then placing these angled wave making devices adjacent to an array of wave making devices. The angled wave making devices are arranged and orientated such that when they generate a wave, the generated wave converges with the waves generated from the array of wave making devices. This convergence of waves constitutes a wave-wave interaction. This wave-wave interaction replicates the physical process of wave focusing and favors the creation of a plunging and peeling wave.

In U.S. Pat. No. 4,705,428A, Per Anderson, A machine for making (gravity) waves on the free surface of a body of water comprises a platform for machinery having a deck level which is raised above the surface of the water, driving machinery located on the platform for generating reciprocating hoist action, a weighted paddle blade suspended below the surface of the water in a horizontal attitude alongside the machinery platform, suspension means extending from the driving machinery to the weighted paddle blade for imparting vertical oscillations to the paddle blade while maintaining the generally horizontal attitude of the paddle blade.

In U.S. Pat. No. 4,507,018A, Per Anderson, A wave making machine for substantially unidirectional wave making on a water surface comprises at least one support scow, a plunger supported by each scow by means of a linkage which limits the movement of the plunger to substantially vertical movement and a drive mechanism for driving the plunger between a raised position and a lowered position. The plunger has a front face at least a portion of which is upwardly and forwardly inclined and a back face which is substantially vertically oriented whereby upon periodic motion waves are generated at the front face and substantially no waves are generated at the back face of the plunger. A plurality of scows, each supporting a wave making plunger, may be connected in a side by side relationship to form a laterally elongated wave making mechanism. The scows are connected by movable linkage mechanisms which permit independent movement of each adjacent scow.

SUMMARY OF THE INVENTION

The current invention addresses all of the challenges of previous plunger wave makers. The current round plunger wave maker invention has a round bottom and a round front. The previous challenge of a vortex coming off the bottom corners of previous flat cornered plunger designs, has been solved with this current invention. Previous box style plunger designs have a horizontal bottom, vertical lateral sides and flat to angle front panels. As these box style plungers descend rapidly, the water beneath is forced out in the form of horizontal flow. A portion of water mass is drawn into the vortex, increasing its intensity and length scale. The vortex interference concludes, that the plunger surface ought to avoid sharp corners in designing an optimal plunger.

The current invention has a round bottom and round front, which eliminates a vortex. This is because, surging water takes place in front of the round plunger and simultaneously propagates down stream with the accelerated descent of the round plunger. The round plunger design slows down once the wave crest is formed. The displaced water flux is decreased accordingly, lowering the water surface elevation close to the round shaped plunger. In this manner a complete solitary sinusoidal wave is gradually produced and no vortex is observed in this process. In addition, the computed pressure field is continuous and stable. Zero pressure occurs at the wave surface and pressure increases with water depth. The highest pressure appears at the water bottom right below the wave crest. The irrotational velocity field and stable pressure field are beneficial to the wave generation and propagation.

The other challenge with flat bottom and front angled plunger designs, is the swell tends to hook forward toward the top of the crest or will hook backward over the top of the plunger. In the current invention, this problem is solved as the round front design of the plunger causes the water particles to propagate forward all at one time, instead of prematurely hooking forward with a small break. Another issue that takes place with most plunger designs is the water particles will push off the front angled face of the plunger. The current round front in the current invention actually attracts the water particle and keeps them along and up against the plunger surface. The current invention has a round front bottom and front. The top third of the plunger straightens to 90 degrees. This extra height above the round front gives the plunger added wave height.

The component structure and design of the round plunger wave maker is novel and unique. The current invention is made out of carbon steel, dipped in a protective zinc coating and can be quickly bolted together on site. Most other previous plunger inventions are welded together, which is very costly and time consuming. In the current invention, the steel panels are manufactured in modular sections, that can be quickly bolted together on-site saving money and time in assembly. There are two front round steel panels. Also, two side panels on each side and two back panels. These steel panels are strengthened by steel stiffeners. To ensure that the round plunger does not collapse in on itself, the plungers have four bracket supports. Two bracket supports go from the top of the front panels, to the bottom of the back panels. The other two support brackets go front the top of the side panels to the top of the back panels. In addition, the back panels also have two outside support brackets, with one on the top and one on the bottom. The plunger design has four bearing brackets. The four bearing brackets are bolted on the back panel of the plunger. Two on the top and one on the bottom. One on the left and one on the right, top and bottom. Attached to the four bearing brackets are HDPE bearings. These bearings run along two steel I beams. The two steel I beams are cemented in foundations on both sides of the back, of the plunger. A cylinder beam is fastened between the two I beams for support. Another cylinder beam is bolted on the other side of the I beams, like a sandwich design. The dual ended hydraulic cylinder connects in between the two-cylinder beams, as well and to a bracket at the bottom rear of the plunger. The HDPE bearings are much less expensive than stainless steel wheels and bearings. If they need to be replaced, they are much cheaper and easier to be replaced, do to wearing. The plunger I beams are bolted into a cement wall to the rear of the round plunger wave maker. There are three indentations in the cement wall that allow the I beams to indent into the wall making the rounded plunder wave maker to be flush against the back 90 degree cement wall. The current invention has a unique and novel closed loop hydraulic design to offset loads, which greatly reduce forces, pressures, component sizes and costs.

What makes this current invention round plunger wave maker novel compared to other previous plunger patents, is that the round plunger wave maker increases wave heights, eliminates vortex, eliminates backward hook swells, eliminates forward hooking premature breaking, eliminates secondary waves, quick and easy assembly on site, low cost bearings, efficient hydraulic design, energy efficient, low cost to operate, higher quality of waves produced, wave frequency favorable for surfing every 12 seconds, novel assembly and design, unique and novel design is stable and will function well under forces.

BASIC DESCRIPTION OF THE DRAWINGS

FIG. 1. A side top-down view of the rounded plunger wave maker on a 90-degree cement wall.

Figure 2:
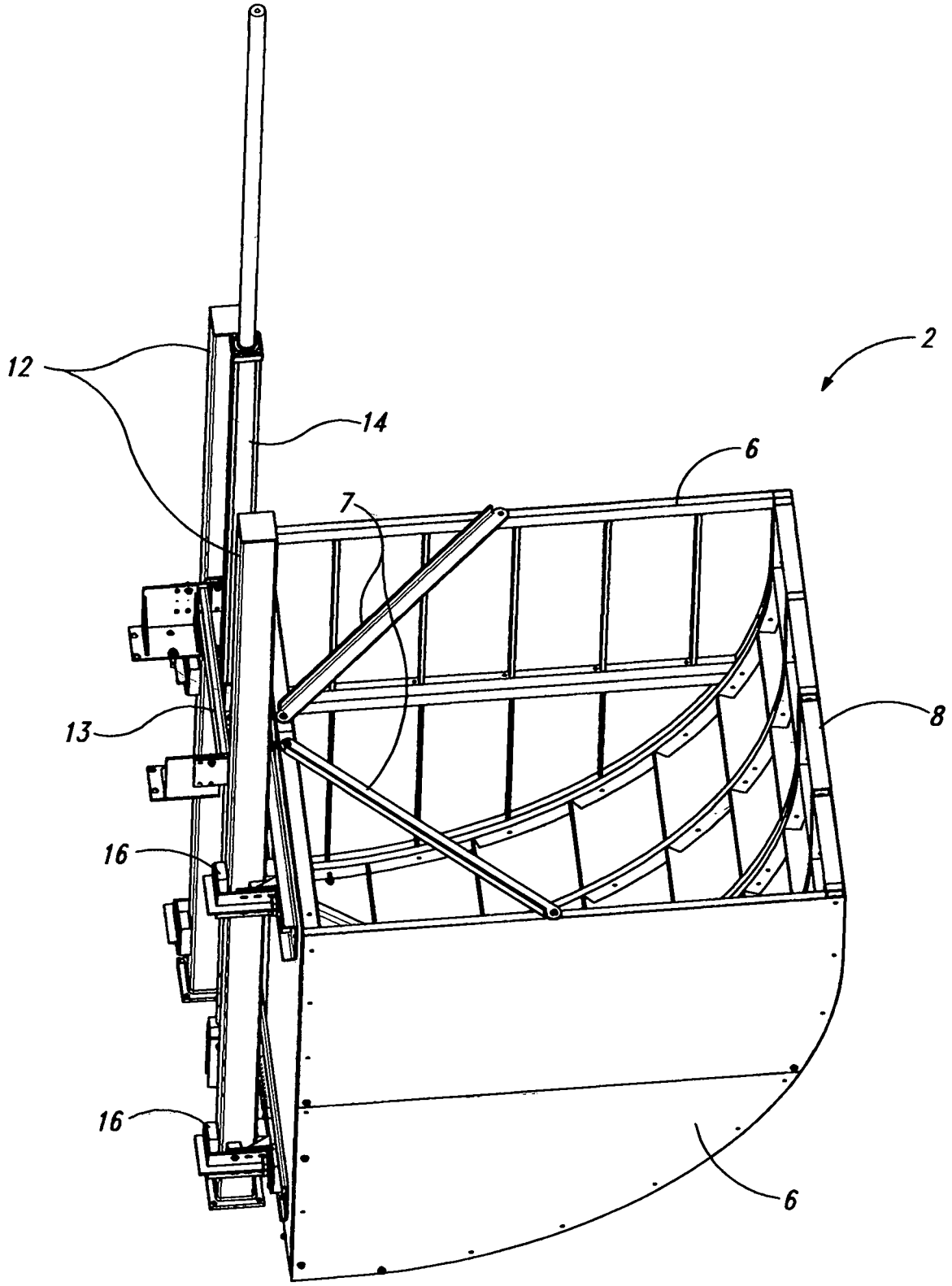

FIG. 2. A rear view of the rounded plunger wave maker.

Figure 3:
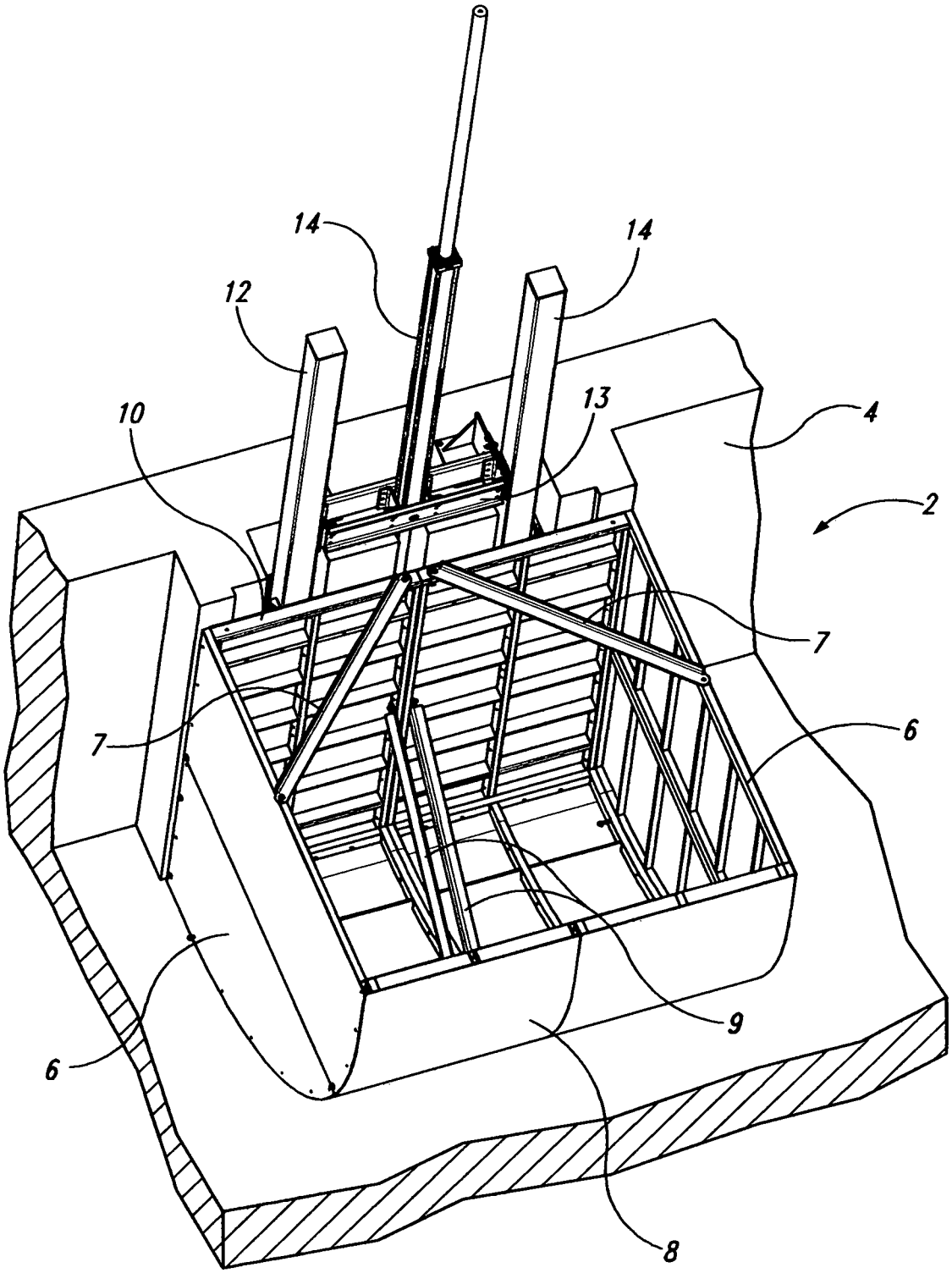

FIG. 3. A top-down view of the rounded plunger wave maker.

Figure 4:
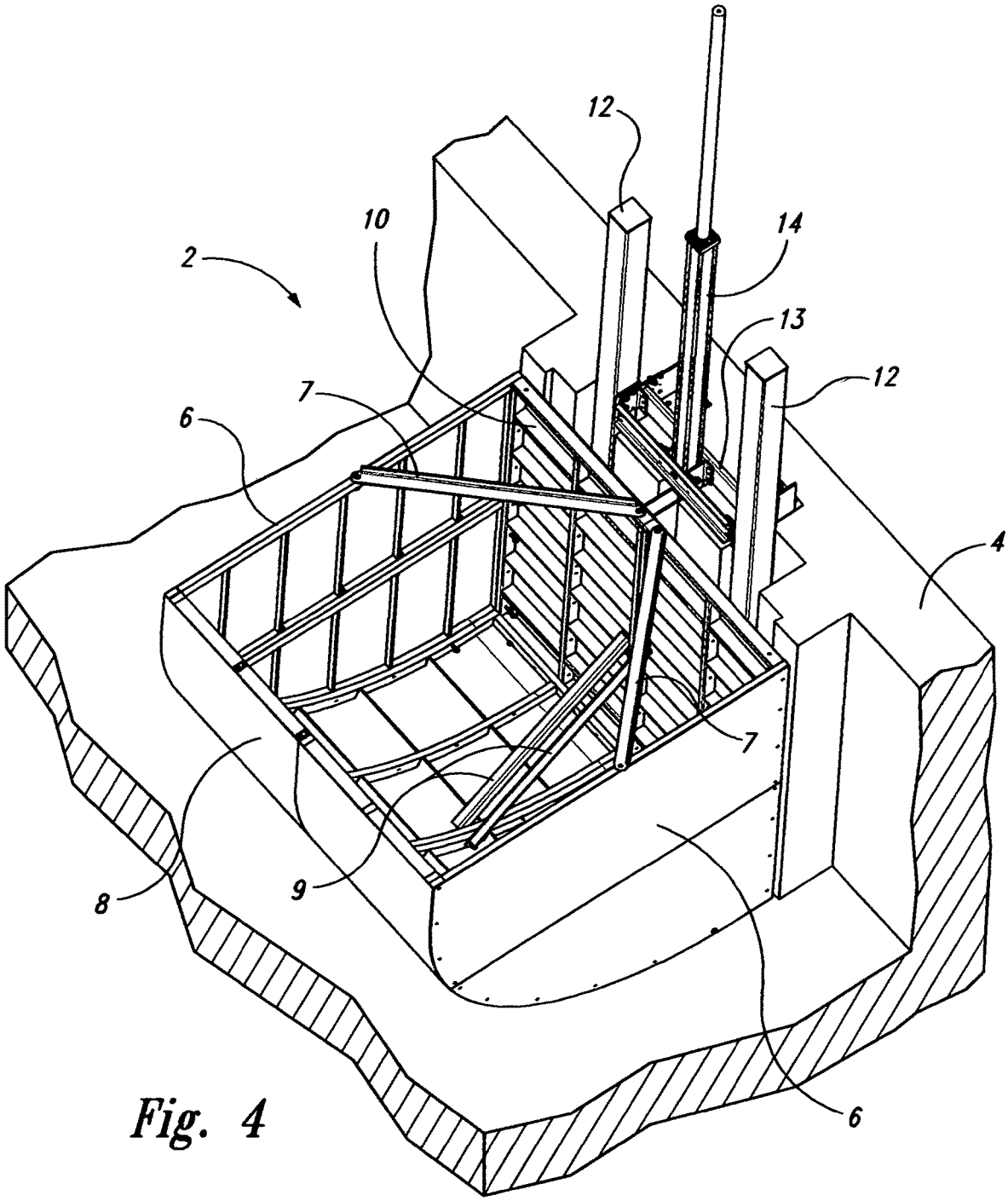

FIG. 4. A top-down view of the rounded plunger wave maker with emphasis on the back and bottom of the plunger.

Figure 5:
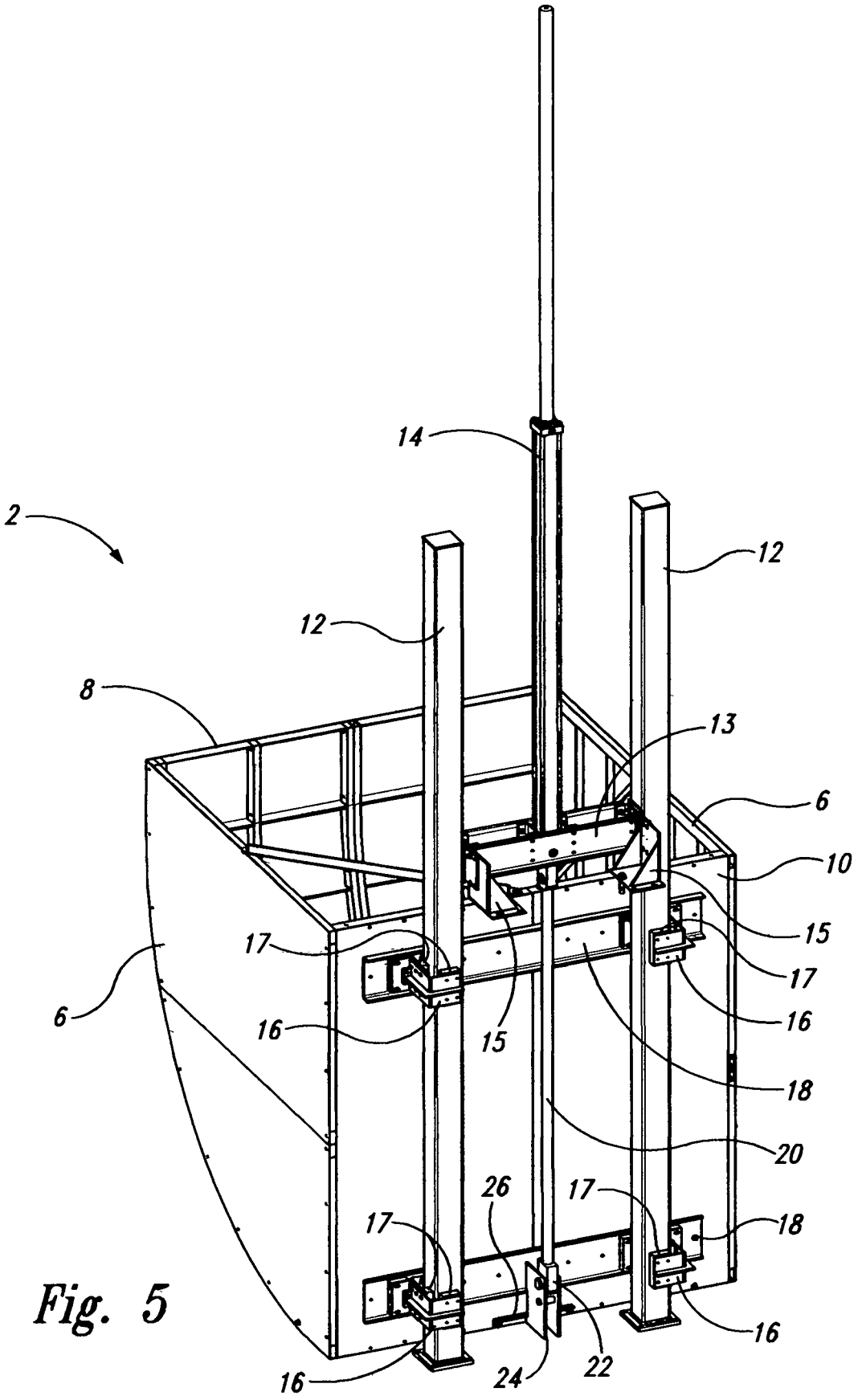

FIG. 5. A top and side view of the rounded plunger wave maker.

Figure 6:
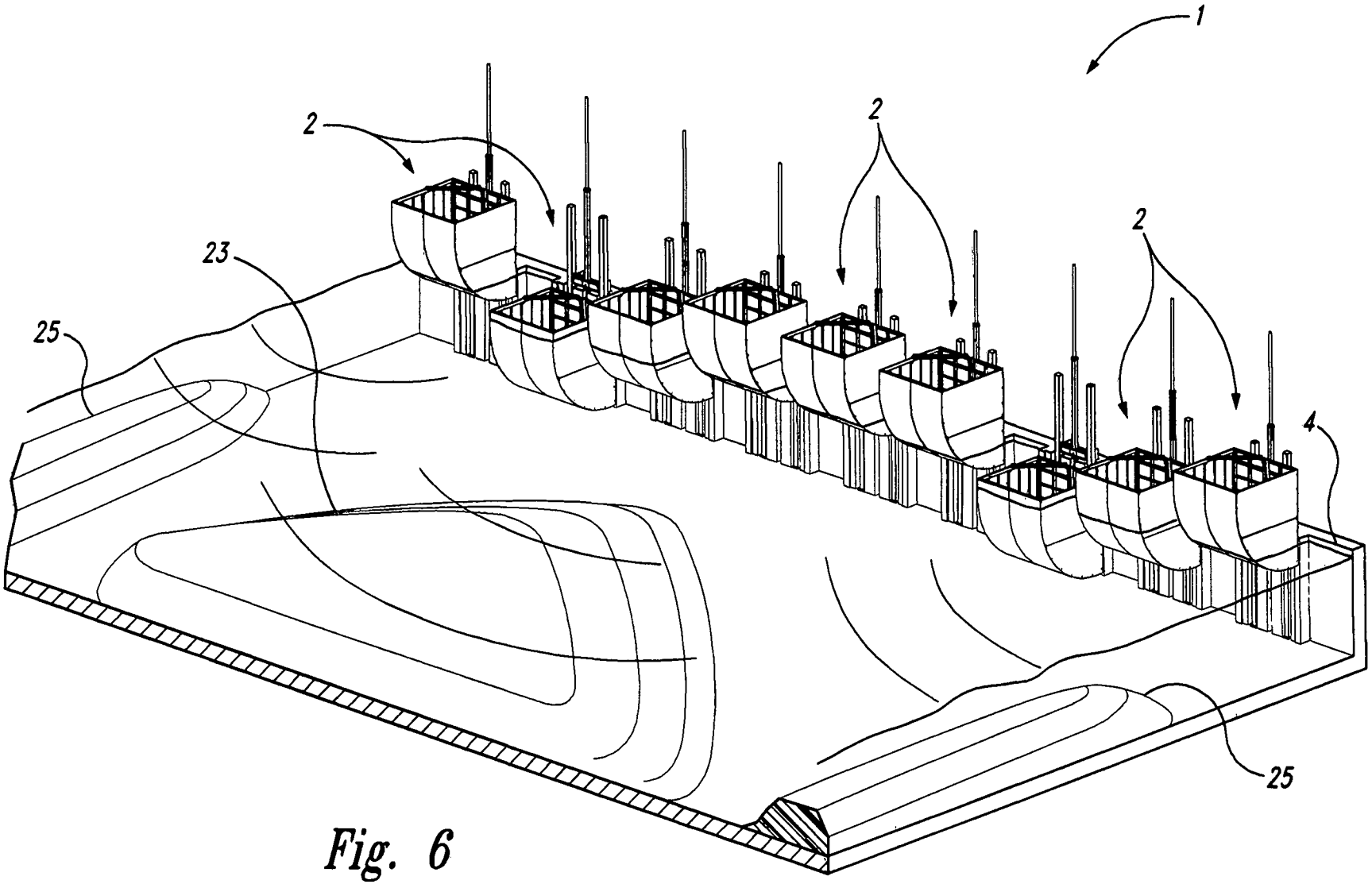

FIG. 6. A top-down view of the rounded plunger wave makers actuating up and down and producing a swell into the body of water.

DETAILED DESCRIPTION OF THE DRAWINGS

FIG. 1. Shows the round plunger wave maker 2, in the down position resting on a cement foundation 4. The front round steel panel 8, which extends to the bottom of the plunger 2, is bolted to two side steel panels 6 and a back steel panel 10. There are two I beams 12 on each side of the rear of the round plunger wave maker 2. The cylinder beams 13, fastens to the I beams 12. In between the two-cylinder beams 13, is a dual ended hydraulic cylinder 14.

FIG. 2. Shows the rear view of the round plunger wave maker 2. Shown in the drawing are the cylinder beams 13, with the dual ended hydraulic cylinder 14 bolted in between. The bearing bracket 16 are bolted to both the I beam 12. Attached to the top of the back steel panel are two supports 7, that connect to each of the sides of the plunger 6.

FIG. 3. Is a top down view of the round plunger wave maker 2. The top support brackets 7, connect from the back steel panel 10 to the side panels 6. The bottom support brackets 9 are connected to the rear panel 10 and to the front panel 8. The front steel panel 8, extends down to the bottom of the plunger 2. The back steel panel 10 and one side panel 6 are shown in drawing. The bottom supports 9 and the top support brackets 7 provide support to the round plunger wave maker so it doesn't collapse in on itself.

FIG. 4. Is a top down view of the round plunger wave maker 2. The top support brackets 7 are shown connecting the back wall panel 10 to the side steel panels 6. There are bottom support brackets 9, shown connecting the back panel 10 to the front steel panel 8. In the rear of the round plunger wave maker 2, are the steel I beams 12. In between the two-cylinder beam brackets 13, is the dual ended hydraulic cylinder 14.

FIG. 5. Is a side view of the round plunger wave maker 2. The outer view of the steel side panel 6 and the inner view of the opposite side panel 6 are illustrated. A side view of the I beams 12, with the bearing bracket 16 run along the I beams 12. The HDPE Bearings 17, run along the I beams 12. There is a top and bottom plate bracket 18, that bolts to the rear of the round plunger wave maker 2. The bearing bracket 16 bolts to the top and bottom plate brackets 18. Bolted to the inside of the bearing bracket 16, are the HDPE bearing brackets 17. Bolted on both sides of the dual ended hydraulic cylinder 14, are two-cylinder beams 13. Bolted to the inside of the I beams 12, are two concrete anchors 15. The bottom bracket 22 at the end of the dual ended hydraulic cylinder rod 20, of the dual ended hydraulic cylinder 14, bolts to a cylinder bracket 24 at the bottom of the round plunger wave maker 2. Securing the cylinder bracket 24 to the round plunger wave maker 2 is a nut rod 26.

FIG. 6. Is a top down view of the round plunger wave maker 2, shown as a plurality of side by side plungers 2. The round plunger wave maker 2, is actuating at different times, in sequence and plungers all at the same time. The rear of the of the round plunger wave makers 2, are anchored to the back cement wall 4. The first set from left to right of the round plunger wave makers 2 and actuating at different times. The next set of round plunger wave makers 2, are shown actuating in sequence. The next three round plunger wave makers 2, are shown all actuating at the same time. The actuating round plunger wave makers 2, push out a swell, which then break over an A frame artificial reef 23 and side artificial reefs 25.

The invention claimed is:

1. A round front plunger wave maker for generating waves into a body of water comprising:

a round front steel panel and a steel bottom panel and, a side steel panel on both sides of the round plunger wave maker and, wherein the round front steel panel bolts to the side steel panel on both sides and, a steel top support bracket and, a steel bottom support bracket and, wherein the bottom support bracket is bolted to a rear steel panel and to the round front steel panel and, wherein the round front steel panel, rear steel panel, side steel panels and the steel bottom panel bolt together to form the round plunger wave maker and, wherein the bottom and top steel support brackets provide support to the round plunger wave maker so the round plunger wave maker doesn't collapse in on itself and, two cylinder beams and, a cylinder bracket and, a steel vertical guide beam on both sides of the round plunger wave maker and, wherein each cylinder beam is bolted to the steel vertical guide beams on both sides of the round plunger wave maker and, a dual ended hydraulic cylinder and, wherein the dual ended hydraulic cylinder is bolted in place between the two cylinder beams and, a top plate bracket on the rear of the round plunger wave maker and, a bottom plate bracket on the rear of the round plunger wave maker and, a bearing bracket and, a high-density polyethylene bearing and, wherein the bottom and top plate brackets bolt to the bearing bracket and, wherein the high-density polyethylene bearing is bolted to the bearing bracket and the high-density polyethylene bearing slides up and down on the steel vertical guide beams and, wherein the round plunger wave maker alongside a plurality of additional round plunger wave makers are actuated by respective dual ended hydraulic cylinders and the round plunger wave maker goes up and down on the steel vertical guide beams and pushes a wave or swell out into the body of water and breaks over an artificial reef and, a nut rod and, where in the nut rod secures the cylinder bracket to the rear panel of the round plunger wave maker and the dual ended hydraulic cylinder bolts to the cylinder bracket and, a concrete anchor and, a concrete wall base and, wherein the concrete anchor bolts to the top of the concrete wall base.

2. The round plunger wave maker as cited in claim 1 further comprising; wherein the plurality of round plunger wave makers are placed side by side to produce a wave into a body of water and breaks over an artificial reef.

3. The round plunger wave maker as cited in claim 1 wherein the plunger wave maker is placed on a back wall of 90 degrees.

4. The round plunger wave maker as cited in claim 1 wherein the round plunger wave maker can be placed in any shaped configuration to produce a wave or swell into a body of water and breaks of an artificial reef.

5. The round plunger wave maker as cited in claim 2 wherein the round plunger wave makers actuate at the same time to produce a swell into a body of water and breaks over an artificial reef and, wherein the round plunger wave makers actuate at different times to produce a swell into a body of water and breaks over an artificial reef and, wherein the round plunger wave makers actuate in sequence to produce a swell into a body of water and breaks over an artificial reef.

* * * * *